US005255910A

United States Patent [19]

Simonseth

[11] Patent Number: 5,255,910

[45] Date of Patent: Oct. 26, 1993

[54] BASKETBALL GOAL ASSEMBLIES

[75] Inventor: John Simonseth, Snohomish, Wash.

[73] Assignee: Basketball Products International, Inc., Everett, Wash.

[21] Appl. No.: 900,173

[22] Filed: Jun. 16, 1992

[51] Int. Cl.[5] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 2,049,593 | 8/1936 | Schabinger | 273/1.5 R |
| 3,194,555 | 7/1965 | Humphrey | 273/1.5 R |
| 4,111,420 | 9/1978 | Tyner | 273/1.5 R |
| 4,348,022 | 9/1982 | O'Donnell | 273/1.5 R |
| 4,365,802 | 12/1982 | Ehrat | 273/1.5 R |
| 4,433,839 | 2/1984 | Simonseth | 273/1.5 R |
| 4,441,709 | 4/1984 | Schroeder et al. | 273/1.5 R |
| 4,534,556 | 8/1985 | Estlund et al. | 273/1.5 R |
| 4,583,732 | 4/1986 | Allen | 273/1.5 R |
| 4,676,503 | 6/1987 | Mahoney et al. | 273/1.5 R |

*Primary Examiner*—Paul E. Shapiro
*Attorney, Agent, or Firm*—Hughes & Multer

[57] ABSTRACT

An apparatus for suspending a basketball goal assembly above a basketball playing surface. The apparatus comprises: (a) a housing having an array of through holes formed therein; (b) a basketball ring attached to the housing; (c) a plurality of mounting plates each having an array of mounting holes formed therein; (d) a backboard having an array of holes formed therein; (e) a structural member having an array of holes formed therein, the structural member being suspended above the basketball playing surface; and (f) attachment bolts and nuts for allowing any one of the plurality of mounting plates to be attached to the housing. The arrays of holes in the housing, the mounting plate attached thereto, the backboard, and the structural member are aligned to allow mounting bolts to be so inserted through the various holes that the housing is rigidly suspended above the basketball playing surface. By selecting the mounting plate having a hole array that matches the hole array in the backboard and structural member on which the ring is to be mounted, the housing and ring easily to be adapted to be mounted on a variety of backboards and structural members.

15 Claims, 6 Drawing Sheets

BASKETBALL GOAL ASSEMBLIES

TECHNICAL FIELD

The present invention relates to basketball goal assemblies and, more particularly, to movable basketball goal assemblies designed to alleviate excessive loads applied to the ring assembly thereof.

BACKGROUND OF THE INVENTION

Excessive loads are often applied to basketball rings during their use. These loads are usually applied by basketball players who hang on or slam the ring while executing a "dunk" shot. When a goal assembly rigidly suspends the ring from the backboard, the shock of such excessive loads either deforms the ring itself or, in extreme cases, will shatter a glass backboard. The potential thus exists for injury to players in the vicinity of the goal assembly when these excessive loads are applied to basketball rings.

To alleviate the above-described problem, the National Collegiate Athletic Association (NCAA) has adopted rules allowing the use of movable basketball goal assemblies at the collegiate level. Movable basketball goal assemblies deflect downwardly when excessive loads are applied to the ring assembly thereof to allow the shock created by these loads to be damped or absorbed.

To comply with NCAA rules, a movable basketball goal assembly: (a) must have a locking mechanism which positively locks the basketball ring to the backboard in a horizontal position; (b) must have rebounding characteristics that are identical to those having a non-movable ring; (c) shall not rotate in excess of 30° below its original horizontal position; and (d) shall automatically and instantaneously return to its original horizontal, locked position. A goal assembly constructed to conform to these is a relatively expensive mechanism.

A goal assembly 10 conforming to the requirements set forth in the preceding paragraph is shown attached to a backboard 12 in prior art FIGS. 1 and 2. The goal assembly 10 basically comprises a backboard mounting portion 14 and ring portion 16. The mounting portion 14 basically comprises a housing 18 and a mounting plate 20. The housing 18 is cast from metal and contains a locking mechanism and a shock absorbing mechanism. The housing 18 is welded to the mounting plate 20 along a weld line indicated by reference character 22. Welding the housing 18 to the mounting plate 20 ensures that no play or give exists between the housing 18 and the plate 20. Such play or give might otherwise adversely affect the rebounding characteristics of the assembly 10.

Two upper mounting holes 24 and two lower mounting holes 26 are formed in the mounting plate 20, while two through holes 28 are formed in flanges 30 integrally formed on and extending laterally from the housing 18 (FIG. 2). The through holes 28 are coaxially aligned with the upper mounting holes 24. Extending through the mounting holes 24 and the through holes 28 are a pair of upper mounting bolts 32 (one shown in FIG. 1) adapted to mount the goal assembly 10 through holes 34 in the backboard 12 to holes 36 in a structural member 38 (FIG. 2) that supports the backboard 12. Similarly, a pair of lower mounting bolts 40 (one shown in FIGS. 1 and 2) extend through the lower mounting holes 26 to mount the goal assembly 10 through holes 42 in the backboard 12 and holes 44 in the structural member 38.

Nuts 46 and washers 48 (one set shown in FIG. 2) engage the bolts 32 and 40 to secure the goal assembly 10 to the backboard 12 and structural member 38.

The holes 34, 36, 42, and 44 are arranged differently for different backboards. Specifically, the vertical distance between the holes 34,36 and the holes 42, 44 may vary depending upon the design of the backboard. Because the housing 18 is welded to the mounting plate 20, once constructed, the entire prior art goal assembly 10 is dedicated for use with a backboard having a given arrangement of holes therein.

Prior Art

Representative of basketball goal assemblies having movable ring assemblies are U.S. Pat. Nos.: (a) 4,433,839 issued to Simonseth; (b) 4,441,709 issued to Schroeder et al.; (c) U.S. Pat. No. 4,534,556 issued 13 Aug. 1985 to Estlund et al.; (d) U.S. Pat. No. 4,365,802 issued 28 Dec. 1982 to Ehrat; (e) U.S. Pat. No. 4,111,420 issued 5 Sept. 1978 to Tyner; (f) U.S. Pat. No. 3,194,555 issued 13 July 1965 to Humphrey; (g) U.S. Pat. No. 4,348,022 issued 7 Sept. 1982 to O,Donnell; (h) U.S. Pat. No. 2,049,593 issued 4 Aug. 1936 to Schabinger; (i) U.S. Pat. No. 4,676,503 issued 30 June 1987 to Mahoney et al. To applicant's knowledge, none of these references allow a basketball goal assembly to be easily adapted to fit a variety of backboard hole arrangements.

OBJECTS OF THE INVENTION

In view of the foregoing, it is apparent that an important object of the present invention is to provide improved movable basketball goal assemblies.

Another important, but more specific, object of the present invention is to provide a movable basketball goal assembly having a favorable mix of the following factors:

a. easily adaptable to conform to hole configurations on various basketball backboards;
b. conforming to NCAA rules; and
c. allowing the basketball ring assembly to be inexpensively manufactured and stocked.

SUMMARY OF THE INVENTION

These and other objects are achieved by the present invention, which is an apparatus for suspending a basketball goal assembly above a basketball playing surface, comprising: (a) a housing having an array of through holes formed therein; (b) a basketball ring attached to the housing; (c) a plurality of mounting plates each having an array of mounting holes formed therein; (d) a backboard having an array of holes formed therein; (e) a structural member having an array of holes formed therein, the structural member being suspended above the basketball playing surface; and (f) attachment means for allowing any one of the plurality of mounting plates to be attached to the housing. The arrays of holes in the housing, the mounting plate attached thereto, the backboard, and the structural member are aligned to allow fastening means to be so inserted through the various holes that the housing is rigidly suspended above the basketball playing surface.

Preferably, the attachment means comprises: (a) at least one attachment bolt fixed to the mounting plate; (b) an attachment hole formed in the housing corresponding to each attachment bolt through which the corresponding attachment bolt extends when the arrays of holes in the housing and mounting plate are aligned;

and (c) a nut so adapted to engage the attachment bolt that the bolt and nut attach the housing to the mounting plate. The mounting plate comprises front and back surfaces, and the attachment bolt is so fixed to the mounting plate that: (a) the back surface of the mounting plate closely abuts a front surface of the backboard; and (b) a right angle is so formed at a juncture between a cylindrical shank of the attachment bolt and the front surface of the mounting plate that the front surface of the housing closely abuts a back surface of the housing.

The present invention may also be embodied in a method of connecting a basketball goal assembly to a backboard and a structural member suspended above a basketball playing surface, comprising the steps of: (a) providing a plurality of mounting plates each having an array of mounting holes formed therein; (b) determinin a type of backboard and structural member to which the goal assembly is to be mounted; (c) after the step of identifying the type of backboard and structural member, so selecting a mounting plate from the plurality of mounting plates that the array of mounting holes in the selected mounting plate matches arrays of holes in the identified backboard and structural member; (d) forming the basketball goal assembly by so attaching the selected mounting plate to a housing having an array of through holes formed therein that the array of through holes aligns with at least a plurality of the mounting holes, where a basketball ring is attached to the housing; and (e) attaching the basketball goal assembly to the backboard and structural member.

DETAILED DESCRIPTION OF THE PREFERRED EMBODIMENT

First Embodiment

Depicted in FIGS. 3–7 is a movable basketball goal assembly 110 constructed in accordance with, and embodying, the principles of a first embodiment of the present invention. In the following discussion, the terms "front" and "back" will refer to the direction towards the bottom left and upper right, respectively, in FIGS. 1–4 and towards the left and right, respectively, in FIGS. 6 and 7. The terms "top, upper" and "bottom, lower" will refer to the corresponding directions in FIGS. 1–8.

Figure 1:
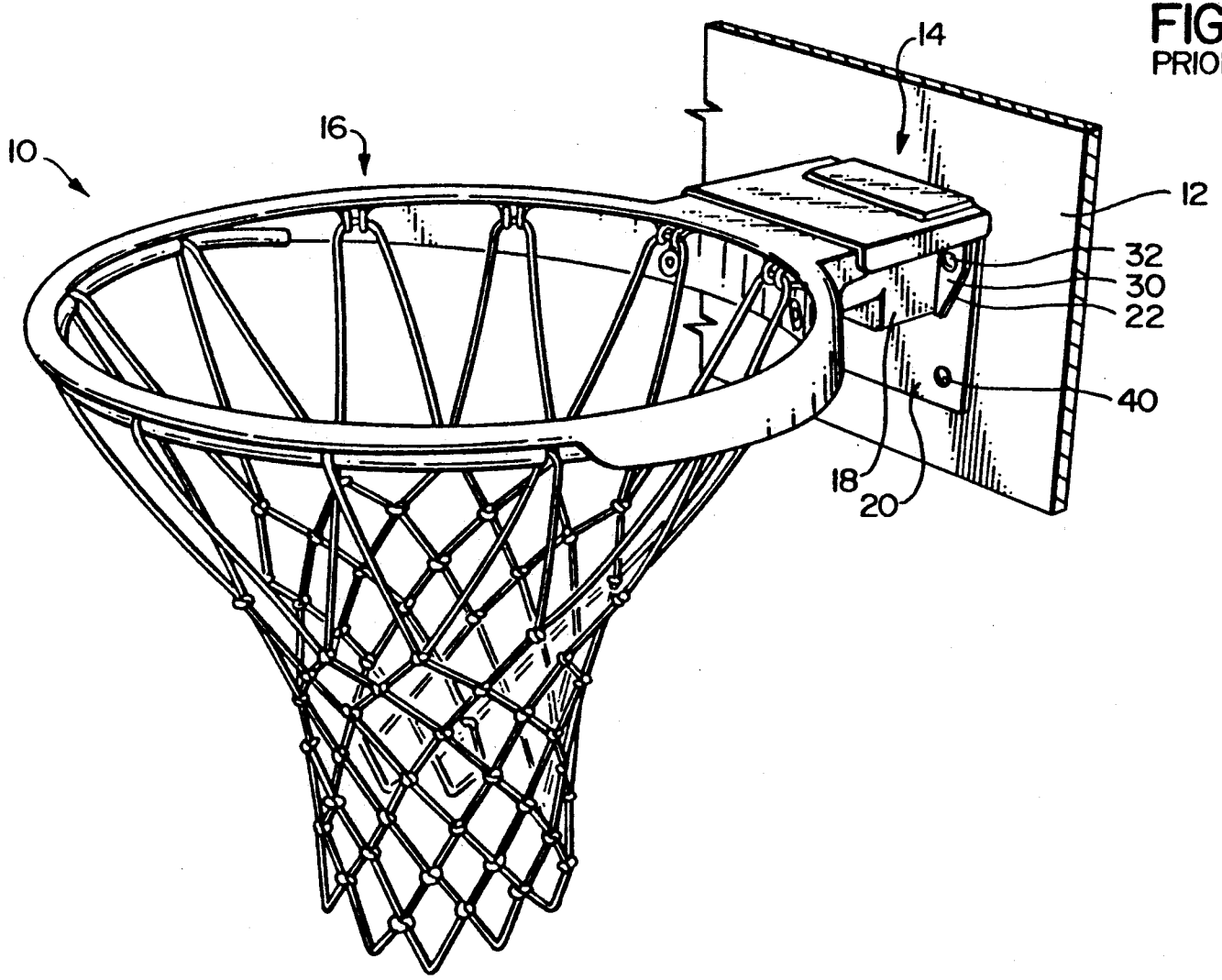
FIG. 1 PRIOR ART
FIG. 1 is perspective view of a movable basketball goal assembly of the prior art.
Figure 2:
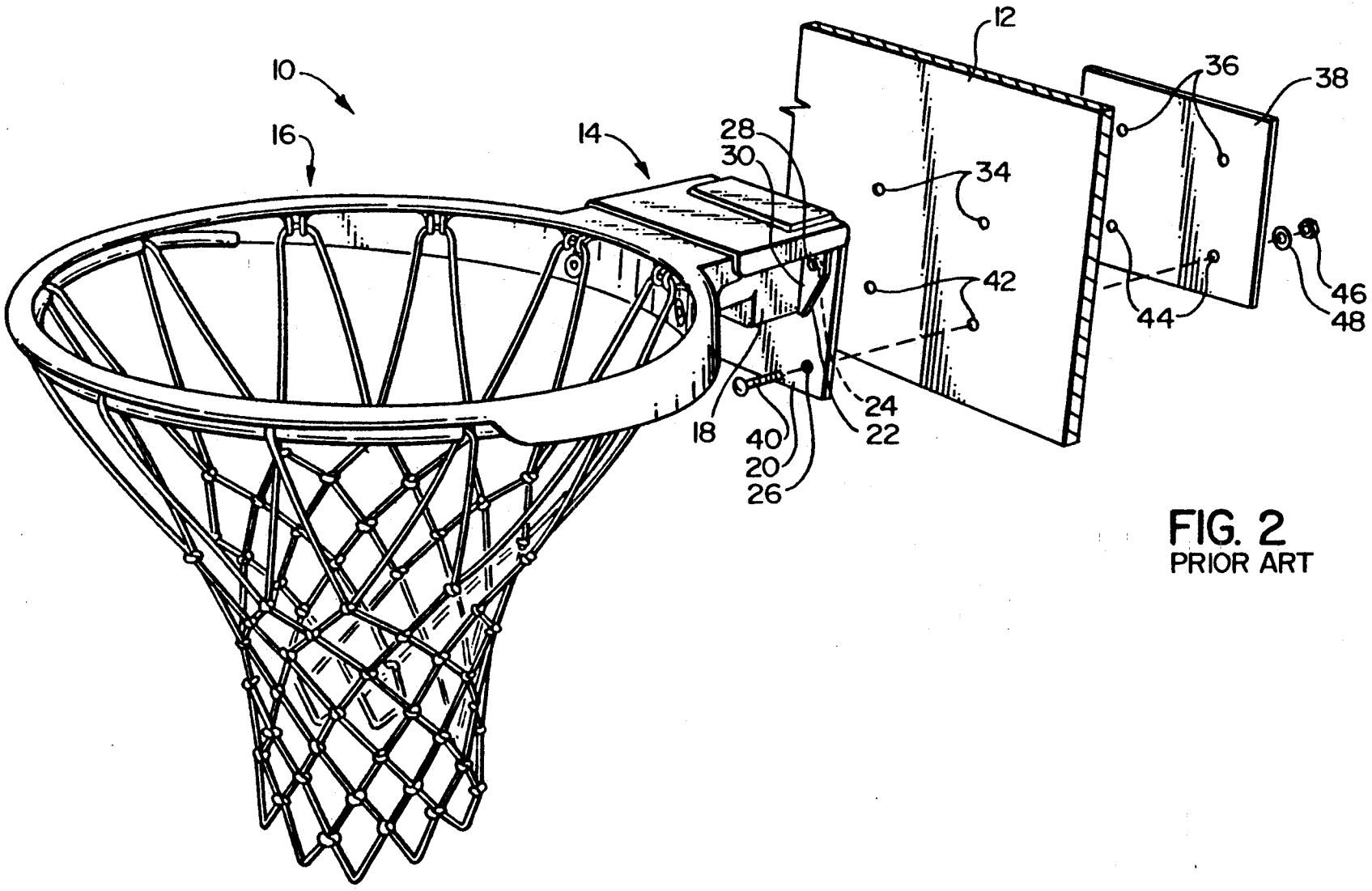
FIG. 2 PRIOR ART
FIG. 2 is an exploded view of the prior art goal assembly depicted in FIG. 1.
Figure 3:
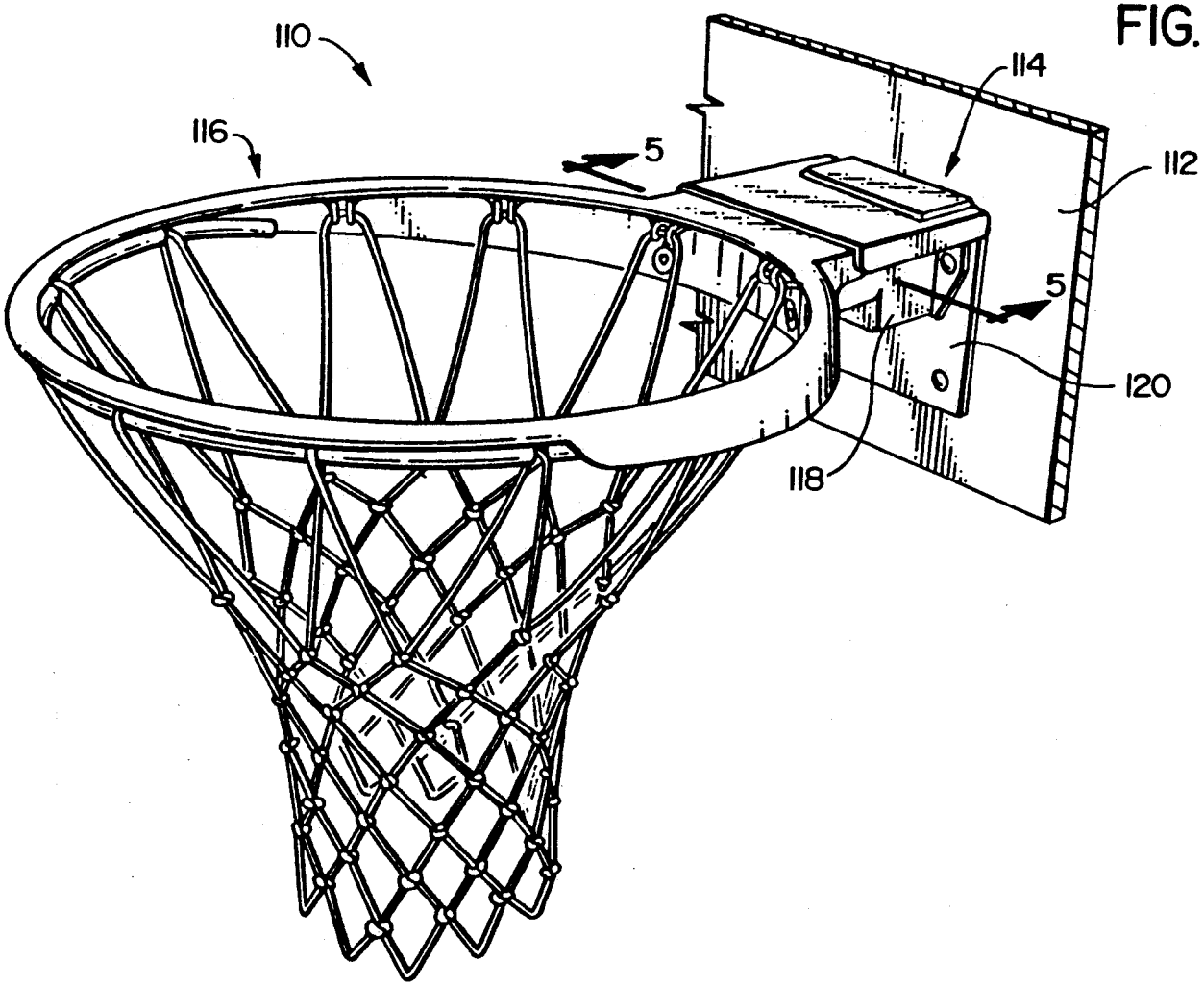
FIG. 3 is perspective view of a movable basketball goal assembly constructed according to the principles of a first embodiment of the present invention.

The goal assembly 110 shown in FIG. 3 is attached to a backboard 112. The goal assembly 110 basically comprises a backboard mounting portion 114 and ring portion 116. The ring portion 116 is described in detail in U.S. patent application Ser. No. 07/822,489 filed on Jan. 14, 1992, by Jolly, so a discussion of the ring portion 116 will not be presented below.

The mounting portion 114 basically comprises a housing 118 and a mounting plate 120. In the following discussion, the combination of the ring portion 116 and the housing 118 will be identified by reference character 119 and referred to as a ring/housing combination.

The housing 118 is cast from metal and contains a locking mechanism and a shock absorbing mechanism. The locking mechanism and shock absorbing mechanism, which are described in detail in U.S. patent application Ser. No. 07/856,680 filed on Mar. 19, 1992, by Jolly, are not per se part of the present invention and thus will not be described in further detail herein.

Figure 4:
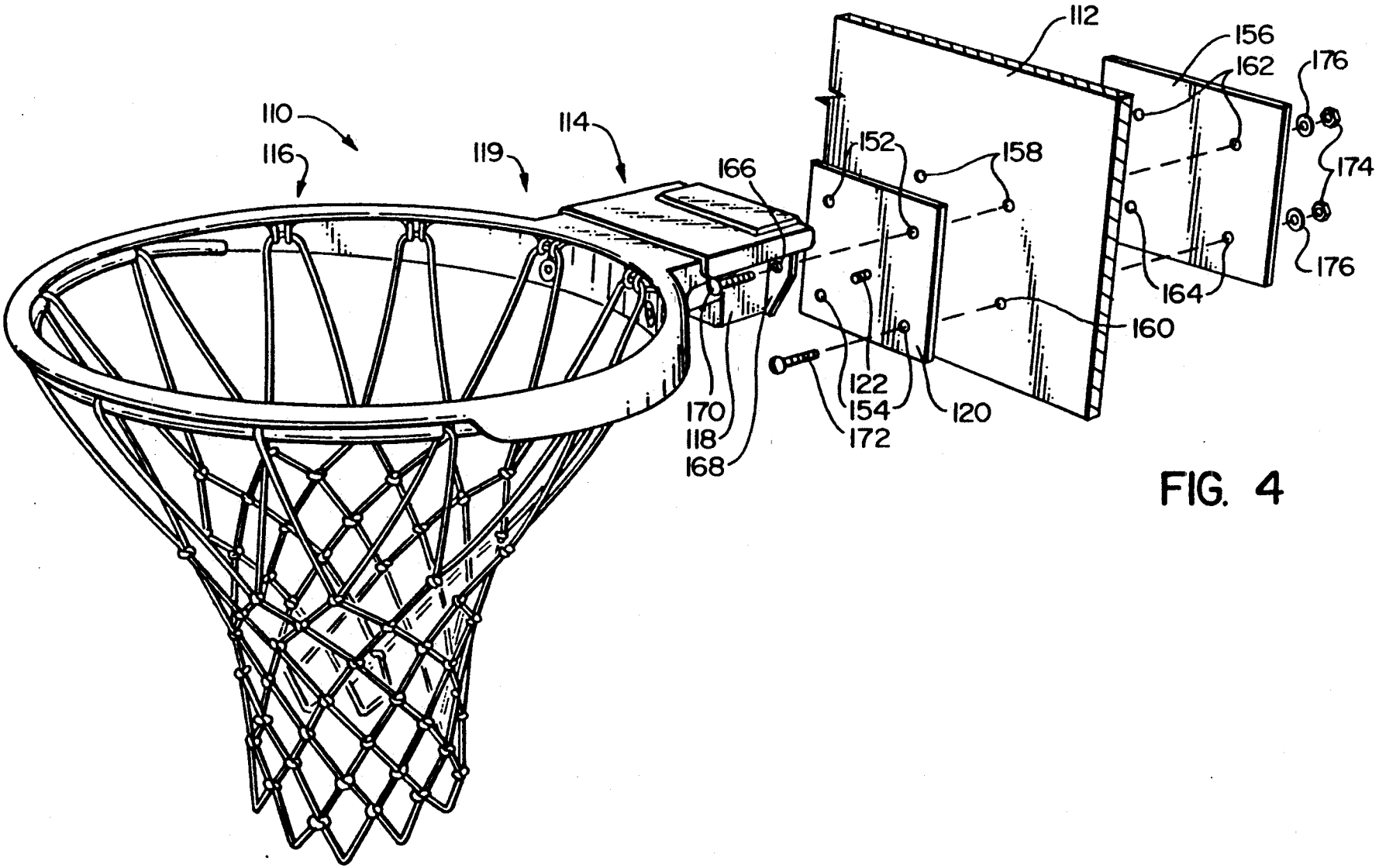
FIG. 4 is an exploded view of the goal assembly of the present invention depicted in FIG. 3.
Figure 5:
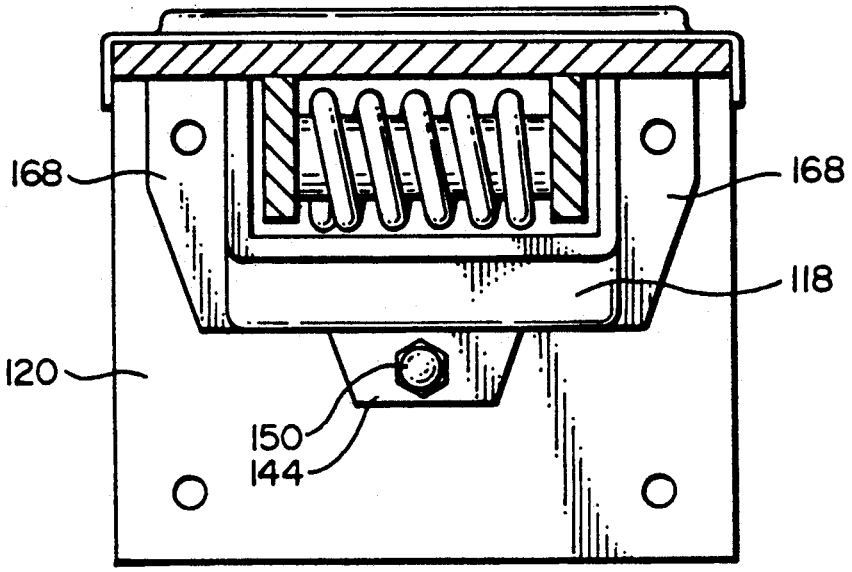
FIG. 5 is a front cut-away view taken along arrows 5 in FIG. 3 showing the number and location of attaching bolts.

In the goal assembly 110 of the preferred embodiment, the housing 118 is not welded to the mounting plate 120. Instead, the mounting plate 120 is a completely separate member that is connected to the mounting plate 120 with an attachment bolt indicated by reference character 122 (FIG. 4). Briefly, by selecting an appropriate mounting plate 120 for a given backboard 12 from among a plurality of mounting plates, the present invention allows the ring/housing unit 119 to be used with any one of a number of different backboards 12.

Figure 7:
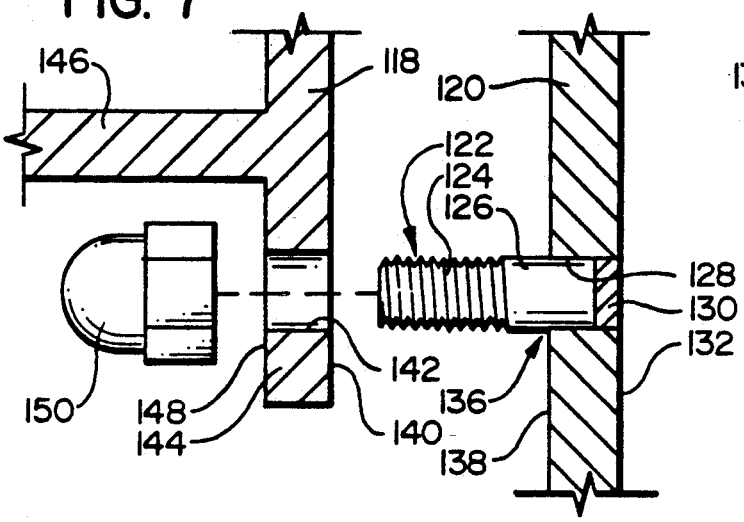

As shown in more detail in FIGS. 4, 7, and 9, the attachment bolt 122 perpendicularly extends from mounting plate 120. The mounting plate 120 itself is formed from a rectangular sheet of ¼" sheet metal. The attachment bolt 122 comprises a threaded front portion 124 and a cylindrical back portion 126. The Applicant has discovered that the bolt 122 is preferably attached to the plate 120 with what is commonly referred to as a stud weld. Specifically, a hole 128 is formed in the plate 120. The bolt 122 is inserted into this hole with its back portion 126 extending into, but not all the way through, the hole 128. With the bolt 122 so inserted into the hole 128, a back portion of the hole 128 is not filled. The back of the bolt 122 is then so welded to the plate 120 that the back, unfilled portion of the hole 128 becomes filled as indicated at reference character 130 in FIG. 7. This process rigidly fixes the attachment bolt 122 to the mounting plate 120.

A stud weld as described above and shown in FIG. 7 ensures that: (a) no projections are formed on a back surface 132 of the mounting plate 120 that would otherwise prevent this back surface 132 from closely abutting a front surface 134 of the backboard 112; and (b) a right angle is formed at a juncture 136 between the shank of the bolt 122 and a front surface 138 of the mounting plate 120. The right angle formed at this juncture 136 allows a back surface 140 of the housing 118 to abut the front surface 138 of the mounting plate 120. Any means of attaching the bolt 122 to the mounting plate 120 that allows the surfaces 132, 134 and 138, 140 to abut each other as just-described can be substituted for the stud weld described above.

The attachment bolt 122 extends through an attachment hole 142 (FIG. 7) in a flange 144 that extends downwardly from a bottom wall 146 of the housing 118. This flange 144 is centrally located below the housing 118 and is integrally formed with the rest of the housing 118 when it is cast. The flange 144 preferably extends downwardly from the housing 118.

When the bolt 122 is so inserted through the attachment hole 142 that the the mounting plate front wall 138 abuts the housing back wall 140, the threaded portion 124 of the bolt 122 extends forwardly from a front surface 148 of the flange 144. An acorn nut 150 adapted to matingly receive the threaded portion 124 engages the bolt 122 to secure the housing 118 to the mounting plate 120. The acorn nut 150 covers the potentially sharp ends of the attachment bolt 122 and contains only rounded edges to prevent injury to players in the vicinity. The attachment bolt 122 and acorn nut 50 comprise an attachment means for attaching the mounting plate 112 to the housing 118.

As best shown in FIG. 4, the mounting plate 120 has four mounting holes formed therein: two upper mounting holes 152 and two lower mounting holes 154 arranged in a rectangular array. Further, four holes are also arranged in a rectangular array in each of the backboard 112 and a structural member 156. Specifically, two upper holes 158 and two lower holes 160 (one shown in FIG. 4) are formed in the backboard 112, while two upper holes 162 and two lower holes 164 are formed in the structural member 156. Finally, a pair of through holes 166 (one shown in FIG. 4) are formed in side flanges 168 extending laterally on either side of the housing 118.

The horizontal distance between any pair of holes 152, 154, 158, 160, 162, 164, and 166 is standard (5 inches) for the housings 118, mounting plates 120, backboards 112, and structural members 156. However, the vertical distance between the upper holes 152, 158, and 162 and the lower holes 154, 160, and 164 depends upon the type of backboard used. In a first backboard type (referred to as a "short" backboard) the vertical distance is 4 inches, while in a second type this distance is 5 inches. As will be described in further detail below, the array of holes in the mounting plate 120 is formed to align with the arrays of holes in the housing flanges 168, backboard 112, and structural member 156.

Figure 6:
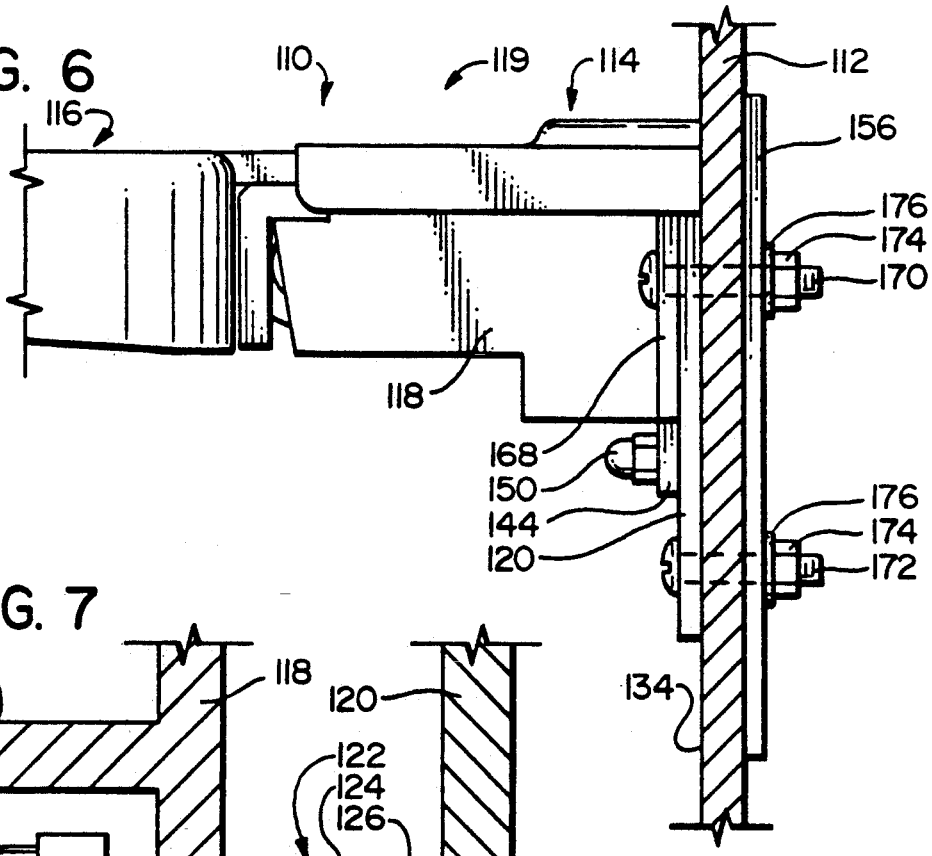
FIGS. 6 and 7 are partial side cut-away views taken along arrows 6 and 7 in FIG. 3.

As shown in FIGS. 4 and 6, to mount the goal assembly 110 onto the backboard 112 and the structural member 156, a pair of upper mounting bolts 170 are inserted through the holes 166 in the flanges 168 and the upper holes 152, 158, and 162, in that order. A pair of lower mounting bolts 172 are inserted, in the following order, through lower holes 154, 160, and 164. Nuts 174 and washers 176 engage the bolts 170 and 172 to secure the goal assembly 110 to the backboard 112 and the structural member 156. The mounting bolts 172, nuts 174, and washers 176 form a mounting means for mounting the goal assembly 110 to the backboard 112 and structural member 156. The structural member 156 is so suspended in a known manner above a basketball playing surface (not shown) that, when the goal assembly 110 is secured to the structural member 156, the goal assembly 110 is fixed at a desired height above a given point on the playing surface.

The invention constructed and assembled as described above is used in the following manner. Initially, the ring/housing unit 119 is formed as described in the U.S. patent applications (Ser. Nos. 07/822,489 and 07/856,680) identified above. The types of backboards 112 and structural members 156 to which the goal assembly 110 is to be attached are then determined according to the dimensions and pattern of the array of holes therein. Next, a plurality of mounting plates 120 are manufactured with arrays of holes 152, 154 formed therein, where the array of holes 152, 154 in each mounting plate 120 matches the arrays of holes 158, 160 and 162, 164 in each of the different styles of backboards 112 determined in the previous step.

When an order for a goal assembly 110 is received, the type of basketball backboard 112 to which the assembly 110 is to be attached is identified. The mounting plate 112 having an array of holes 158, 160 matching the hole arrays on the identified backboard 112 is selected from the plurality of mounting plates 120. The selected mounting plate 120 is then attached to the housing 118 of the ring/housing unit 119 using the attaching bolt 122 and the acorn nut 150 to form the goal assembly 110. The goal assembly 110 is then mounted on the identified backboard 112 and the structural member 156 associated therewith using mounting bolts 172, nuts 174, and washers 176. The goal assembly 110 is thus fixed a predetermined distance above a known location on the basketball playing surface.

Second Embodiment

Figure 8:
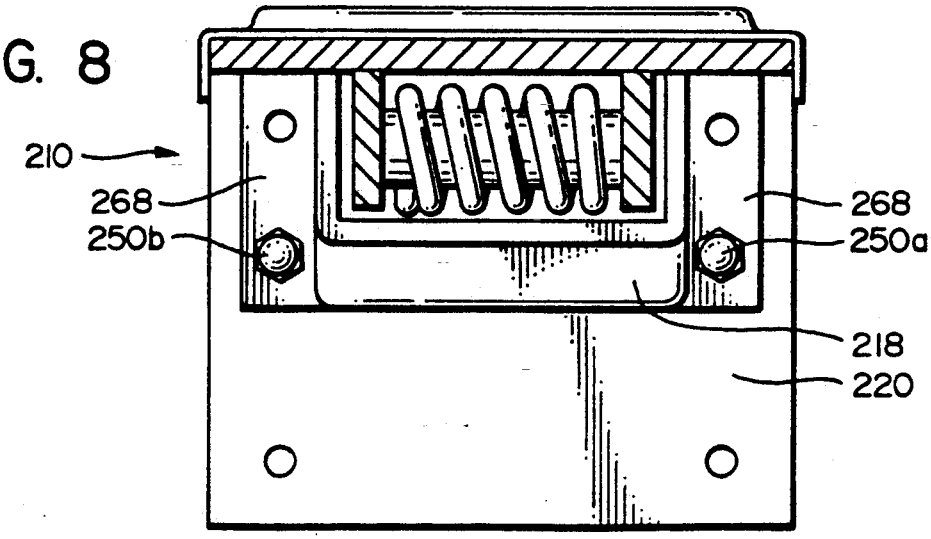
FIG. 8 is a front cut-away view of a second embodiment of the present invention showing the number and location of attaching bolts.

A second embodiment of the present invention is depicted in FIG. 8. Indicated at reference character 210 is a portion of a movable basketball goal assembly constructed in accordance with, and embodying, the principles of this second embodiment. The goal assembly 210 operates in a fashion similar to that of the goal assembly 110 described above and will be described below only to the extent that the two embodiments differ. In the following discussion, the elements of the second embodiment similar to those of the first embodiment will be given the same reference character plus one hundred.

The primary difference in the first and second embodiments is that first and second attachment bolts (not shown) extend from the mounting plate 220 and first and second acorn nuts 250*a*, 250*b* are provided, one for each of the two attachment bolts. Further, instead of providing a single flange, centrally located below the housing 218, in which a single attachment hole is formed, an attachment hole (not shown) is formed in each of the side flanges 268. Thus, in this goal assembly 210, the attaching means is formed by a pair of symmetrically-arranged attachment bolts extending through attachment holes and capped by the acorn nuts 250.

From the foregoing, it should be clear that the present invention may be embodied in forms other than those disclosed above without departing from the spirit or essential characteristics of the present invention. The above-described embodiments are therefore to be considered in all respects illustrative and not restrictive, the scope of the invention being indicated by the appended claims rather than the foregoing description. All changes that come within the meaning and scope of the claims are intended to be embraced therein.

I claim:

1. An apparatus for suspending a basketball goal assembly above a basketball playing surface, comprising:

a. a housing having an array of through holes formed therein;

b. a basketball ring attached to the housing;

c. a plurality of mounting plates each havrng an array of mounting holes formed therein;

d. a backboard having an array of holes formed therein;

e. a structural member having an array of holes formed therein, the structural member being suspended above the basketball playing surface; and f. attachment means for allowing any one of the plurality of mounting plates to be attached to the housing; wherein the arrays of holes in the housing, the mounting plate attached thereto, the backboard, and the structural member are aligned to allow mounting means to be so inserted through the various holes that the housing is rigidly suspended above the basketball playing surface.

2. An apparatus as recited in claim 1, in which the attachment means comprises:

a. at least one attachment bolt fixed to the mounting plate;

b. an attachment hole formed in the housing corresponding to each attachment bolt through which the corresponding attachment bolt extends when the arrays of holes in the housing and mounting pate are aligned; and c. a nut so adapted to engage the attachment bolt that the bolt and nut attach the housing to the mounting plate.

3. An apparatus as recited in claim 2, in which the attachment bolt is fixed to the mounting plate by a stud weld process.

4. An apparatus as recited in claim 2, in which the mounting plate has first and second planar surfaces, where the attachment bolt is so fixed to the mounting plate that the mounting bolt perpendicularly extends from the first planar surface.

5. An apparatus as recited in claim 2, in which the mounting plate comprises front and back surfaces and the attachment bolt is so fixed to the mounting plate that:

a. the back surface of the mounting plate closely abuts a front surface of the backboard; and b. a right angle is so formed at a juncture between a cylindrical shank of the attachment bolt and the front surface of the mounting plate that the front surface of the housing closely abuts a back surface of the housing.

6. A method of connecting a basketball goal assembly to a backboard and a structural member suspended above a basketball playing surface, comprising the steps of:

a. providing a plurality of mounting plates each having a dufferebt arrat of mounting holes formed therein;

b. determining a type of backboard and structural member to which the goal assembly is to be mounted;

c. after the step of identifying the type of backboard and structural member, so selecting a mounting plate from the plurality of mounting plates that the array of mounting holes in the selected mounting plate matches arrays of holes in the identified backboard and structural member;

d. forming the basketball goal assembly by so attaching the selected mounting plate to a housing having an array of through holes formed therein that the array of through holes aligns with at least a plurality of the mounting holes, where a basketball ring is attached to the housing; and e. attaching the basketball goal assembly to the backboard and structural member.

7. A method as recited in claim 6, in which the step of forming the basketball goal assembly comprises the steps of :

a. fixing at least one attachment bolt to the mounting plate;

b. so forming an attachment hole in the housing corresponding to each attachment bolt that the corresponding attachment bolt extends through the attachment hole when the arrays of holes in the housing and mounting plate are aligned; and c. attaching the housing to the mounting plate with a nut adapted to engage the attachment bolt.

8. A method as recited in claim 7, in which the step of fixing the attachment bolt to the mounting plate comprises the step of stud welding the attachment bolt to the mounting plate.

9. A method as recited in claim 7, in which the mounting plate has first and second planar surfaces, where the step of fixing the attachment bolt to the plate comprises the step of so fixing the attachment bolt to the mounting plate that the mounting bolt perpendicularly extends from the first planar surface.

10. A method as recited in claim 7, in which the mounting plate comprises front and back surfaces and the attachment bolt is so fixed to the mounting plate that:

a. the back surface of the mounting plate closely abuts a front surface of the backboard; and b. a right angle is so formed at a juncture between a cylindrical shank of the attachment bolt and the front surface of the mounting plate that the front surface of the housing closely abuts a back surface of the housing.

11. An apparatus for suspending a basketball goal assembly above a basketball playing surface, comprising:

a. a housing having first and second side flanges and a through holes formed in each of the side flanges;

b. a basketball ring attached to the housing;

c. a plurality of mounting plates each having an array of mounting holes formed therein, where the array of holes in each of the mounting plates contains a pair of upper mounting holes and a pair of lower mounting holes and the vertical distance between the upper and lower mounting holes is different for each of the plurality of mounting plates;

d. a backboard having an array of holes formed therein, the array of holes in the backboard comprising a pair of upper holes and a pair of lower holes;

e. a structural member having an array of holes formed therein, where the structural member is suspended above the basketball playing surface and the array of holes in the structural member comprises a pair of upper holes and a pair of lower holes;

f. attachment means for allowing any one of the plurality of mounting plates to be attached to the housing to form a basketball goal assembly; and g. mounting means for mounting the basketball goal assembly to the backboard and structural member; wherein the upper holes in the hole arrays formed in the mounting plate attached to the housing, the backboard, and the structural member are spaced the same vertical distance from the lower holes formed in the the mounting plate attached to the housing, the backboard, and the structural member.

12. An apparatus as recited in claim 11, in which the attachment means comprises:

a. at least one attachment bolt fixed to the mounting plate;

b. an attachment hole formed in the housing corresponding to each attachment bolt through which the corresponding attachment bolt extends when the arrays of holes in the housing and mounting plate are aligned; and c. a nut so adapted to engage the attachment bolt that the bolt and nut attach the housing to the mounting plate.

13. An apparatus as recited in claim 12, in which the attachment bolt is fixed to the mounting plate by a stud weld process.

14. An apparatus as recited in claim 12, in which the mounting plate has first and second planar surfaces, where the attachment bolt is so fixed to the mounting plate that the mounting bolt perpendicularly extends from the first planar surface.

15. An apparatus as recited in claim 12, in which the mounting plate comprises front and back surfaces and the attachment bolt is so fixed to the mounting plate a. the back surface of the mounting plate closely abuts a front surface of the backboard; and b. a right angle is so formed at a juncture between a cylindrical shank of the attachment bolt and the front surface of the mounting plate that the front surface of the housing closely abuts a back surface of the housing.

* * * * *